US005190231A

United States Patent [19]

Sarfati

[11] Patent Number: 5,190,231

[45] Date of Patent: Mar. 2, 1993

[54] FEED DEVICE FOR TRAVELLING THREADS

[75] Inventor: Alberto G. Sarfati, Como, Italy

[73] Assignee: Société de brevets industriels-Etablissement, Vaduz, Liechtenstein

[21] Appl. No.: 712,067

[22] Filed: Jun. 7, 1991

[30] Foreign Application Priority Data

Jul. 5, 1990 [DE] Fed. Rep. of Germany ..... 4021461

[51] Int. Cl.[5] ..... B65H 51/22

[52] U.S. Cl. ..... 242/47.08; 242/47.09

[58] Field of Search ..... 242/47.08, 47.09, 47.1, 242/47.11, 47.01, 47.03, 47; 139/452; 66/132 R, 132 T

[56] References Cited

U.S. PATENT DOCUMENTS

| | | | |
|---|---|---|---|
| 2,381,643 | 8/1945 | Bruenner | 242/47.03 |
| 2,471,362 | 5/1949 | Vin | 242/47.09 |
| 3,957,218 | 5/1976 | Coats et al. | 242/47.09 X |
| 4,858,839 | 8/1989 | Niederer | 242/47.09 |
| 4,919,395 | 4/1990 | Ritter et al. | 242/47.08 X |

*Primary Examiner*—Stanley N. Gilreath

*Attorney, Agent, or Firm*—Martin A. Farber

[57] ABSTRACT

A feed device for travelling threads, in particular for bringing them to thread-processing machines such as, for instance, for the introducing of the filling thread into a loom, in which device the thread is fed tangentially to a drum connected with a rotary drive and is removed again from said drum by a draw-off force acting on the other side of the drum, the thread wrapping only around part of the circumference of the drum turning with higher circumferential speed than the thread draw-off speed and being adapted to be brought to the outer surface of the drum in slip entrainment via the draw-off force which is tangential to the drum, in which connection at least two drums which are adjacent to each other with parallel axes are so divided by stationary partition walls that each of the drums forms a plurality of regions, lying one behind the other in the axial direction of the drums, for partial wrapping by the thread in the manner that the thread passes from the region of the one drum to the region of the other drum. In order to optimize the manner of operation of such a feed device, the outer surface of the drum has, in each case, a radially outwardly directed annular collar (R) aligned with the plane of the partition walls (47, 48).

9 Claims, 3 Drawing Sheets

FEED DEVICE FOR TRAVELLING THREADS

FIELD AND BACKGROUND OF THE INVENTION

The present invention relates to a feed device.

A feed device is known which has the advantage that while avoiding the stop-and-go type of operation of a drum, a minimizing of the thread draw-off tension is obtained and that, even in the case of threads of difficult shape, multiple wrappings on the drum are possible while substantially avoiding the passing of layers of thread into each other.

SUMMARY OF THE INVENTION

The objective of the invention is further to develop a feed device of the type in question in such a manner as to optimize its manner of operation.

according o the invention a drum outer surface has in each case a radially outwardly directed annular collar (e.g. R) aligned with a plane of partition walls (e.g. 47, 48).

As a result of this development, there is provided a feed device which is characterized by an optimal manner of operation. Both the partition walls and annular collars of the drum outer surface which are aligned with them reliably prevent adjacent layers of thread from passing over each other upon a multiple wrapping of the drums. Disturbances in the drawing off of the thread as a result of this are accordingly eliminated. The height of the annular collar corresponds to at least the thickness of the thread. A height of a few millimeters is preferably selected so that different yarns can be worked with the same feed device. If an annular slot the size of which also corresponds, at least approximately, to the thickness of the yarn is left between the annular collar and the partition wall, the possibility of thread material being caught therein is also avoided. In this way, optimal operation of the feed device is further improved. In order that the thread, which is deflected by the drums, can never leave its proper path, an air-damming ledge which is directed approximately radially to the outer surface of the drum is, furthermore, provided. It extends in circumferential direction shortly behind the point of tangency between thread and outer surface of the drum. The air-damming ledge produces a flow of air which is directed away from the drum and accordingly to a certain extent presses against the layers of thread. In this way, the thread is prevented from being drawn into the nip of the drums and winding onto one or the other drum. The annular collars support said effect in the manner that the flow of air does not emerge on the side of the drums, but acts directly on the layers of thread. Flow design and construction advantages result from the fact that the air-damming ledges are provided on an arm which is swingable in the direction towards the center of the drums. This arm is held by a supporting web of intermediate walls so that the supporting web, which is any event present, exercises a further function. The arrangement of two diametrically oppositely extending arms with air-damming ledges sees to it that yarn cannot be drawn into either the upper or the lower nip formed by the drums. In particular, it is advantageous to develop the air-damming ledges as a felt which wipes against the outer surface of the drum. On the one hand, this felt has the necessary imperviousness to air. On the other hand, however, it has the required flexibility.

BRIEF DESCRIPTION OF THE DRAWINGS

One embodiment of the invention will be described below with reference to the drawings in which.

DETAILED DESCRIPTION OF THE PREFERRED EMBODIMENT

Figure 1:
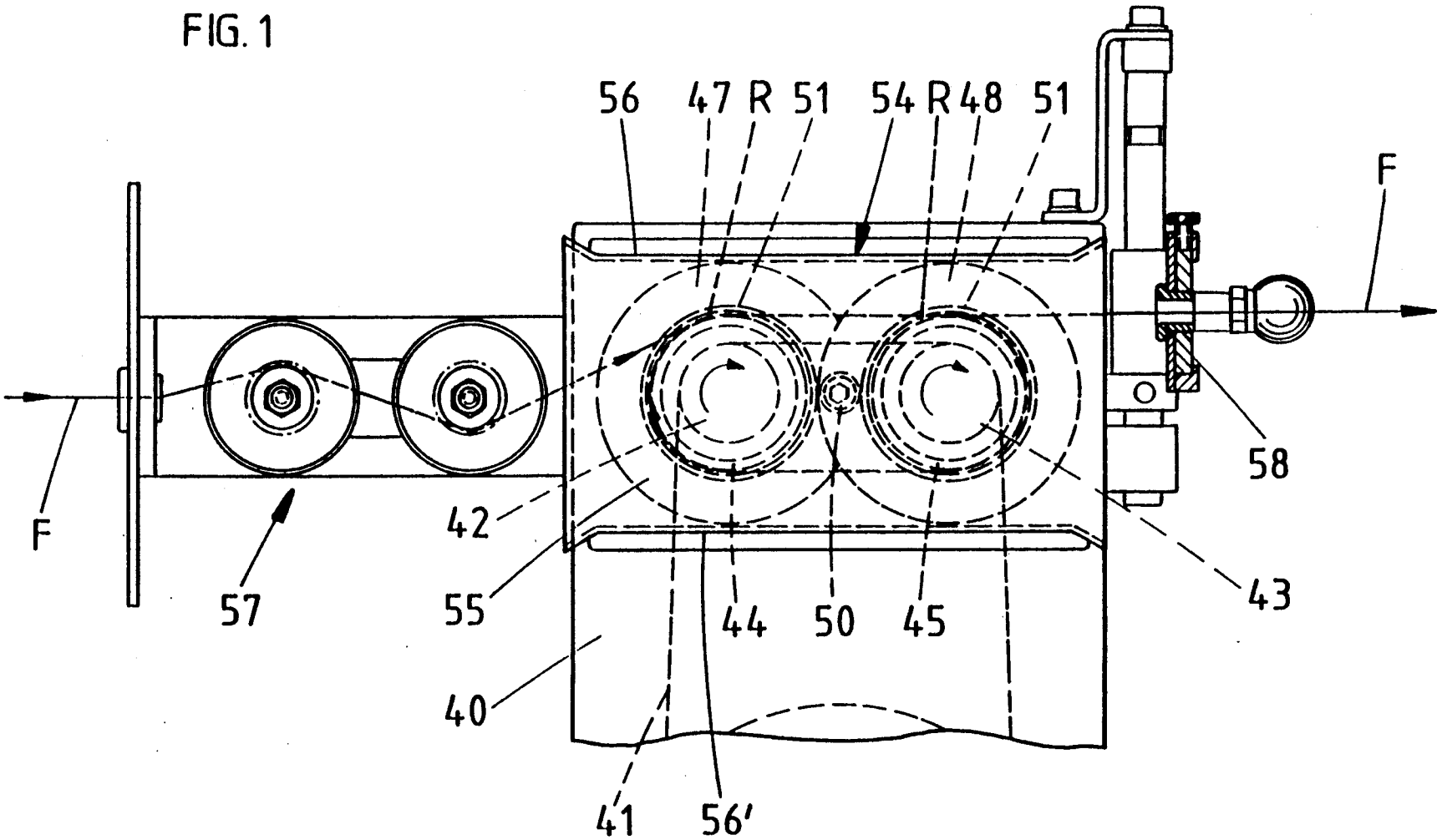
FIG. 1 is a view in elevation of the thread feed device.

The thread feed device has a support column 40 in which a drum drive (not shown) is arranged. Via a drive belt 41, pulleys 42, 43 are placed in rotation in the same direction, each of the pulleys being firmly attached to a respective drum 44, 45. The drums 44, 45 are overhung circular-cylindrical bodies, the axes of which lie in a common horizontal plane and are so arranged that the drums 44, 45 are at a distance apart from each other. The drums 44, 45 are of the same length so that their end free edges are aligned with each other.

In the space between the two drums 44, 45 there extends a web 46 which extends from the supporting column 40 parallel to the drums and serves to hold partition walls 47, 48. The latter have the shape of annular disks, the annular openings in which are passed through by the drums 44 and 45.

In the overlapping regions of the partition walls 47, 48 there are bore holes through which the web 46 passes. Spacer rings 49 extend between adjacent partition walls 47, 48. By means of the latter and a screw 50, the partition walls 47, 48 are held immoveably on the web 46. In this way, the drum outer surfaces are divided into individual regions a' to h' which lie axially shifted with respect to each other.

The drum outer surface is provided with radially outward directed annular collars R which are aligned with the plane of the partition walls 47, 48. The height of each annular collar R is at least as great as the thickness of the thread F to be worked. In actual practice, this means that a value of a few millimeters is selected for the height.

The annular collars R, together with the annular openings in the partition walls 47, 48, form a slot 51 which corresponds, at least approximately, to the diameter of the thread. This slot 51 extends concentrically to the annular collar R or the drum outer surface T. The annular collars R are preferably integral with and of the same material as the drum outer wall T.

The drum outer wall T has a rib-like elevation 52 extending in axial direction on one or more drum sections. In the embodiment shown, this elevation is formed by a bar 53 which is inserted into the drum outer wall T and the circumferential surface of which protrudes beyond the drum outer wall T and forms a protrusion there. A bar 53 of circular cross section the length of which corresponds approximately to that of the drums 44, 45 is present. This means that it also passes through the annular collars R of each drum 44, 45. The bar 53 accordingly does not extend radially beyond the annular collar but is recessed with respect thereto in inward direction. Instead of a continuous bar, bar sections could, however, also be used, they extending between the annular collars R and terminating at them.

It would be possible to arrange the bar 53 in such a manner with respect to the drum wall T that it is displaceable radially inward against spring action. It need not be especially pointed out that the outward displacement of the bar would then have to be limited.

Furthermore, a cover 54 is also provided which extends over the drums 44, 45 and the partition walls 47, 48. It is of U-shaped in cross section. The web 55 of the U-section extends in front of the end sides of the drums 44, 45 and the outer partition walls 47, 48, while the legs 56, 56' of the U-section extend up to the outer edges of the partition walls 47, 48 and form there a protection against the thread skipping from one region of the drum over the partition wall into the other region of the drum.

Figure 4:
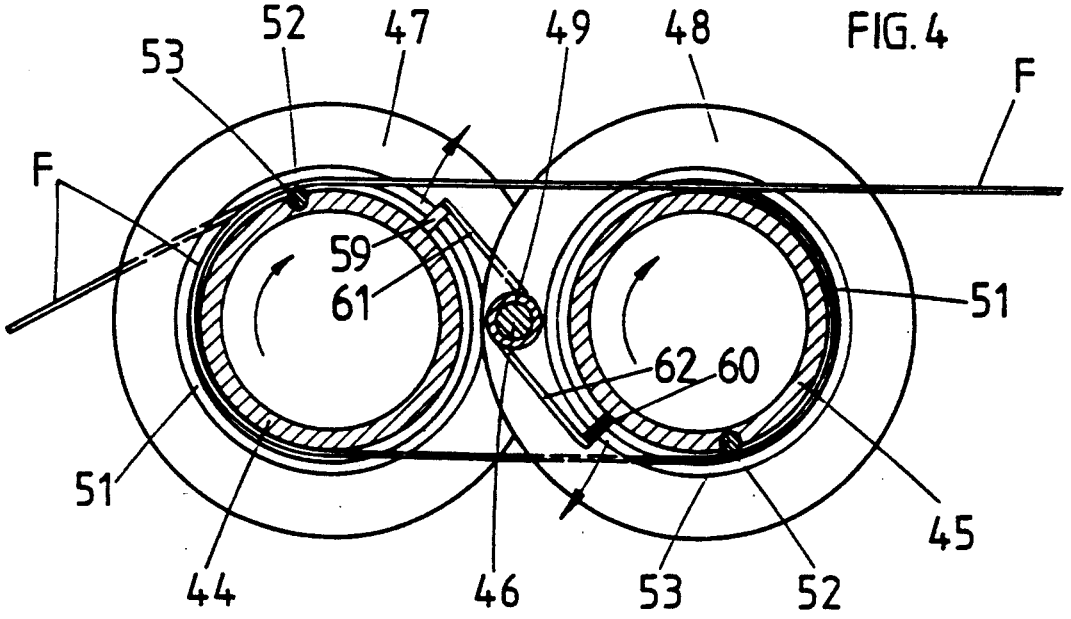
FIG. 4 is a cross section through the drums of the thread feed device which are driven in the same direction.

An approximately radially directed air-damming ledge 59, 60 is so associated with the outer surface of each drum that it lies, as seen in circumferential direction, shortly behind the point of tangency between thread F and drum outer surface. The air-damming ledges 59, 60 are seated on arms 61 and 62 respectively which are swingable in the direction towards the center of the drums 44, 45. The support point for the arm of 61, 62 is formed by the supporting web 46 for the partition walls 47, 48; see FIG. 4. The arms 61, 62 are directed diametrically opposite each other and are of identical shape so that practically identical conditions are present. The arms 61, 62 can be clamped fast on the supporting web. The swingability is then necessary only upon the adjustment of the arms. They can, however, also be developed for swinging during operation. In such case it is at least necessary to bring the lower arm 62 by means of a spring (not shown) into the active position in which the air-damming ledge 60 rests against the outer surface of the drum 45. A spring could also be associated with the other swingable arm 61.

The said air-damming ledges 59, 60 wipe against the surface of the drum and consist of felt of suitable thickness. Therefore, upon contact with the rib-like elevations 52, they can move away for a short time and then return into their position of application against the outer surface of the drum.

Each air-damming ledge 59, 60 is formed of a plurality of short sections which, as a rule, correspond to the distance between the partition walls 47, 48. Therefore, the sections of the air-damming ledges 59, 60, enter into and fill up the space between the annular collars R and the partition walls 47, 48.

Figure 2:
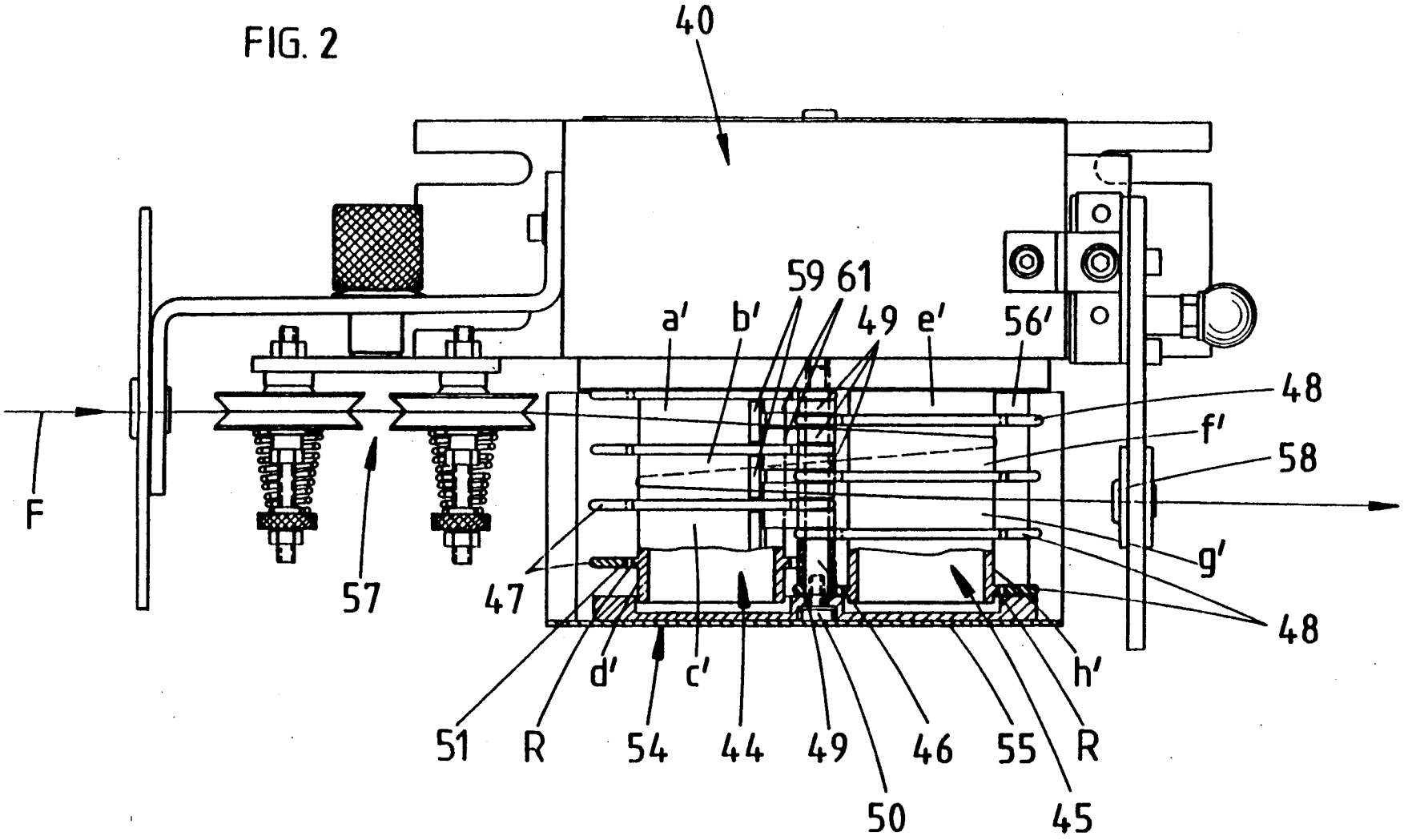
FIG. 2 shows the thread feed device partially in top view and partially in longitudinal section.
Figure 3:
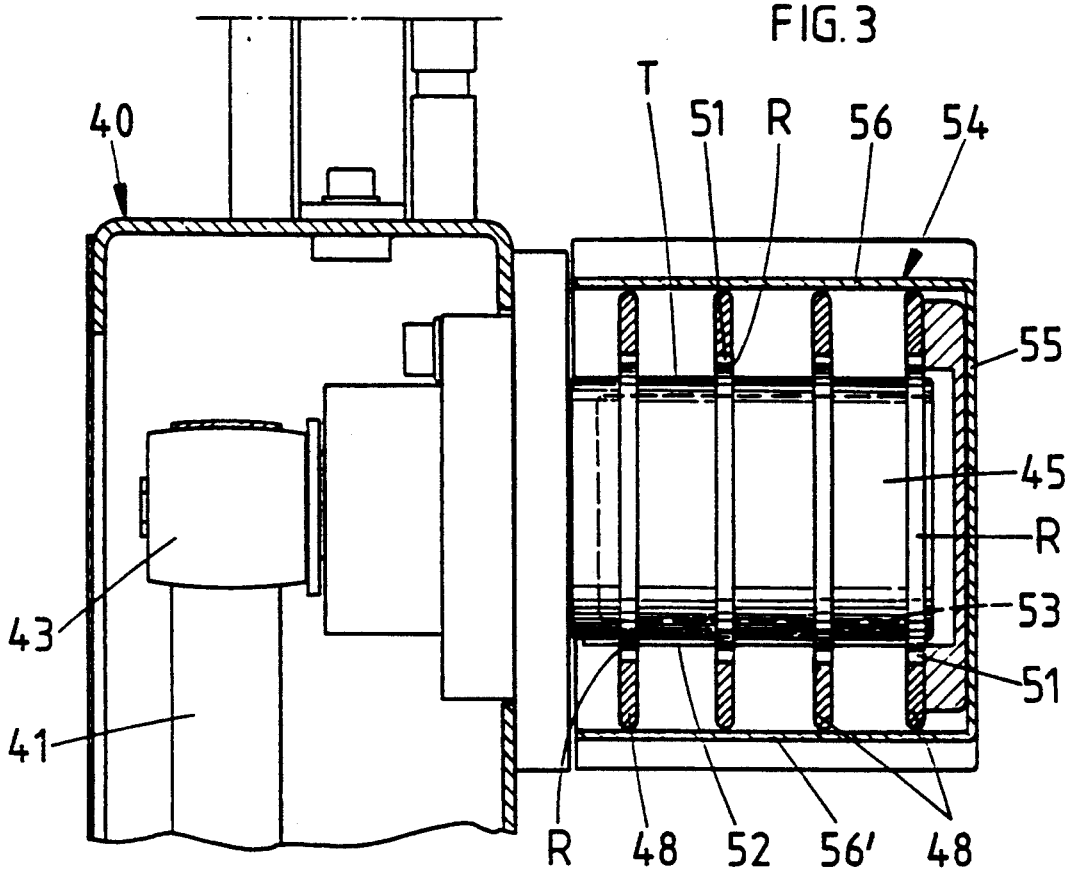
FIG. 3 is a vertical section through the thread feed device in the region of a drum.

After the drawing off of the thread F, the thread passes in the direction indicated by the arrow through an adjustable thread brake 57 and wraps around the drums 44, 45 in the zigzag path which can be noted from FIG. 2. After passing through the partial region g' the thread leaves the thread feed device through a thread eye 58.

If no pull-off tension is applied to the thread F, no slip entrainment of the thread takes place. Upon the introduction of the thread into a loom, controlled, for instance, by water or air, the tension increases with simultaneous slip entrainment of the thread. The bar 53 which forms the rib-like elevation 52 continuously lifts the partial wrappings of the thread F during the slip entrainment, so as to avoid excessive heating thereof; see FIG. 4. From this figure it can be seen that, due to the rib-like elevation 52, the thread is lifted off from the drum outer wall T in the corresponding region.

The thread feed device can have associated with it a time-delay circuit for synchronizing the drum drive to the drive of the corresponding loom.

During the operation of the feed device, the annular collars R prevent the thread from passing from one partial region to the other. The partition walls 47, 48, as well as the cover 54, also contribute to this.

The drawing of the thread F into the nip between the drums 44, 45 present on both sides of the supporting web 56 if the thread draw-off tension should drop is also effectively prevented. The air-damming ledges 59, 60 namely produce a flow of air when the drums 44, 45 rotate in the direction indicated by the arrow, this flow being directed out of the nip and, therefore, away from the drum. In this way, the thread is prevented from entering into the nip of the drums and being unintentionally wound on one or the other drum.

I claim:

1. In a feed device for a travelling thread, particularly for bringing thread to thread-processing machines, in which device the thread is fed tangentially to a drum, said drum being connected with a rotary drive, and wherein the thread is removed from said drum by means of draw-off force acting on a side of the drum tangential to the drum, the thread wrapping partially the circumference of the drum, the drum rotating with higher circumferential speed than speed forwarding-off of the thread, the thread being adapted to be brought to the outer surface of the drum in slip entrainment via the draw-off force, wherein aid drum and at least one other like drum, constituting at least two said drums which are adjacent with parallel axes to one other and are divided by stationary partition walls such that each of aid drums forms a plurality of regions one behind the other in axial direction of the respective drums, the thread partial wrapping said regions in a manner wherein the thread passes from said regions of one drum to respective adjacent of said regions of the other drum, the improvement wherein each of said partition walls defines a plane, and wherein each said outer surface of a corresponding said drum has a radially outwardly directed annular collar aligned with aid plane o the corresponding partition wall.

2. The feed device, according to claim 1, further comprising an air-damming ledge which lies adjacently behind a tangential point between said thread sand si outer surface of he drum as seen in circumferential direction, said air-damming ledge is directed to the outer surface of the drum approximately a radially with respect to said drum.

3. A feed device, according to claim 2, further comprising an arm which is mounted so as to be swingable in a direction towards the center of the drum, said air-damming ledge is seated on said arm.

4. A feed device, according to claim 3, further comprising a supporting web, said partition walls are secured on said supporting web, and said arm extends from said supporting web.

5. A feed device, according to claim 3, wherein there are tow of said air-damming ledges and tow of said arms wherein said two arms extend diametrically oppositely, and said air-damming ledges respectively are seated on said arms respectively.

6. A feed device, according to claim 5, further comprising a supporting web, said partition walls are secured on said supporting web, and said arms extend from said supporting web, and said arms are clamped fast on the supporting web, but adjustable thereon of the swingability of the arms.

7. A feed device, according to claim 3, further comprising spring means for urging in said arm so as to be swingable in a direction towards the center o the drum.

8. A feed device, according to claim 2, wherein said air-damming ledge is formed of felt which wipes against the outer surface of the drum.

9. A feed device, according o claim 2, wherein said air-damming ledge is formed of a plurality of short sections which correspond to the distance between the partition walls on each drum.

* * * * *